US006199294B1

(12) United States Patent
Becker

(10) Patent No.: US 6,199,294 B1
(45) Date of Patent: Mar. 13, 2001

(54) DRYING APPARATUS FOR BULK MATERIALS

(75) Inventor: Achim Becker, Darmstadt (DE)

(73) Assignee: Mann & Hummel ProTec GmbH, Ludwigsburg (DE)

( * ) Notice: Subject to any disclaimer, the term of this patent is extended or adjusted under 35 U.S.C. 154(b) by 0 days.

(21) Appl. No.: 09/428,987

(22) Filed: Oct. 29, 1999

(30) Foreign Application Priority Data

Oct. 30, 1998 (DE) ..... 198 50 303

(51) Int. Cl.[7] ..... F26B 21/06

(52) U.S. Cl. ..... 34/80; 34/168; 34/186; 34/187

(58) Field of Search ..... 34/80, 81, 82, 34/167, 168, 172, 173, 182, 183, 185, 186, 187; 432/17, 37, 45; 110/243, 101 R, 234, 254

(56) References Cited

U.S. PATENT DOCUMENTS 4,370,203 * 1/1983 Schmid et al. ..... 34/168 X
4,521,977 6/1985 Graeff ..... 34/32
5,210,962 * 5/1993 Jones, Jr. ..... 34/168
5,799,412 * 9/1998 Yamamoto et al. ..... 34/168 X
5,893,218 * 4/1999 Hunter et al. ..... 34/168 X

* cited by examiner

*Primary Examiner*—Stephen Gravini
(74) *Attorney, Agent, or Firm*—Evenson, McKeown, Edwards & Lenahan, P.L.L.C.

(57) ABSTRACT

The invention relates to an apparatus for drying bulk materials, which has a hopper-shaped bulk material container 29 with adjustable side walls 30, by which the container 29 can be adjusted to the amount of bulk material to be dried, by varying the volume of the container and the angle of inclination of the hopper. To dehumidify the drying air, a membrane dryer 12 is provided, which processes preferably the compressed air of a compressed-air system 10, which is previously cleaned by filter elements 13 and 14. The rate of flow of drying air can be adjusted by a throttle 16 to the fill level of the container 29. In this manner an apparatus for drying bulk materials is created which is compact and therefore flexible in its application. Through optimization of the rate of flow of the drying air this apparatus is also economical in its consumption of compressed air.

14 Claims, 2 Drawing Sheets

DRYING APPARATUS FOR BULK MATERIALS

STATE OF THE ART

Figure 1:
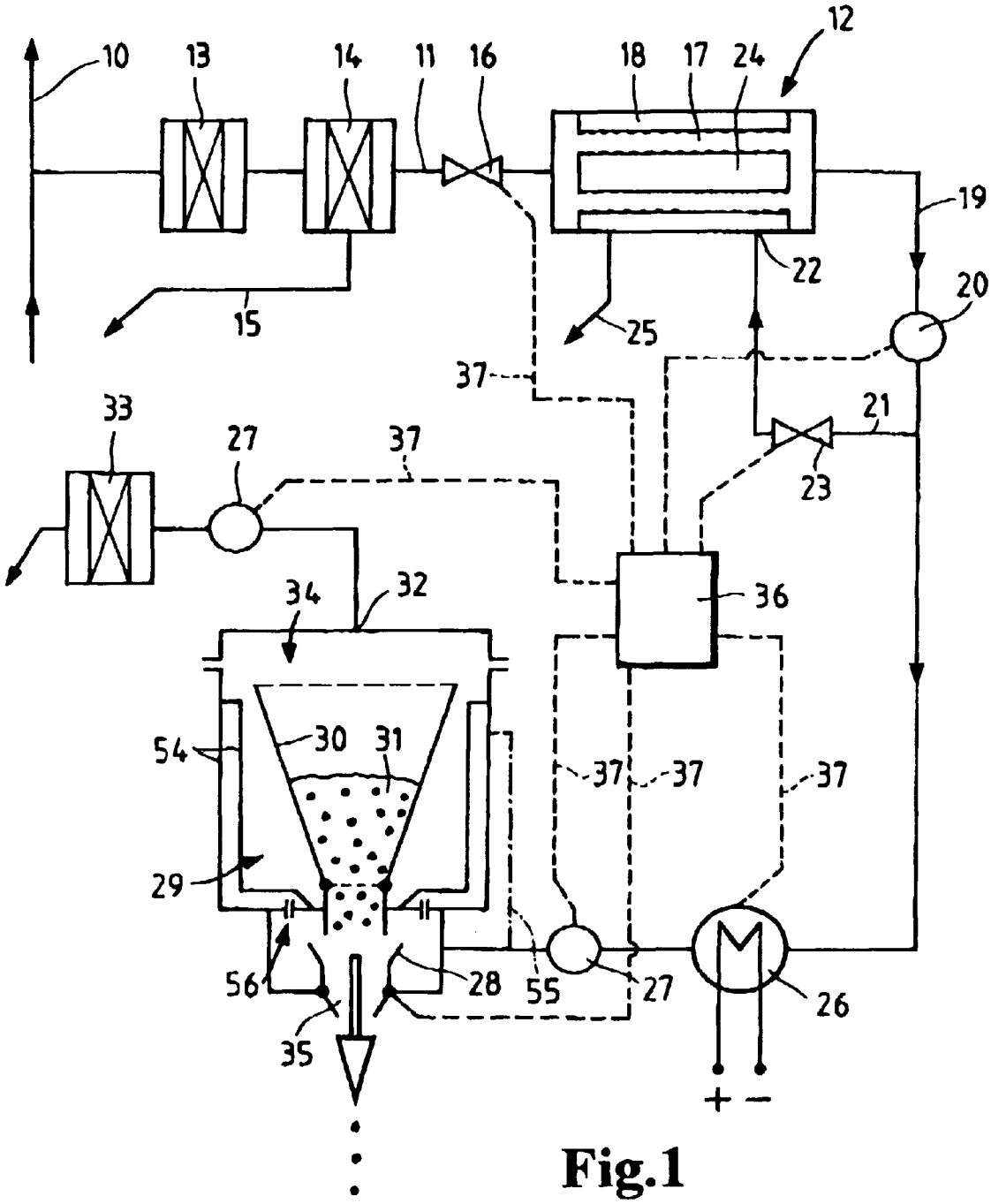

The invention relates to an apparatus for drying bulk materials, having an at least partially funnel-shaped container. The invention moreover relates to a drying apparatus for bulk materials, which has a device for dehumidifying the drying gas that is used.

Drying apparatus for drying bulk materials such as plastic granules, for example, are disclosed in DE 3234431 C2 among others. The granules to be dried are in a container which tapers downwardly with a hopper shape to a granule outfeed and is fed with the granules at the top. To dry the granules they are fed into a drying gas, especially heated air, which carries away the moisture adhering to the granules. To improve the drying results the drying air is previously passed through a dehumidifier.

Drying apparatus are generally designed for a particular throughput of bulk material. The plastic granules are fed after drying, especially to plastic fabricating machines. Previously they are often mixed with other components which constitute a substantially lower percentage in the desired raw material. Conventional dryers are suitable to only a limited extent for the preliminary treatment of additive granules which are used in only small amounts. If they are not completely filled, problems can arise in regard to the granule drying results, because the passage of the drying air through them does not take place in a uniform manner. On the other hand, it is not possible to fill the drying apparatus entirely with granules on account of the time-related degradation of the bulk material. The capacity of the drying apparatus therefore cannot be matched to the desired amount of the dried granular material. In particular, the drying air dehumidifier remains largely underutilized if the drying capacity is reduced, since it has to be designed for the full load capacity of the apparatus. To dehumidify the drying air, regeneratable cartridges containing moisture absorbing substances are often used, which are associated with the granular material dryers as an additional component.

The problem to which the invention is addressed consists in creating a drying apparatus for bulk materials which can be optimally adapted to the amount of the granular material to be dried, especially small amounts thereof, and will have great flexibility, especially with regard to the different places where it will be used.

This problem is solved by providing a granular material container with adjustable walls. Furthermore, a drying apparatus is provided which has a membrane dryer as dehumidifier.

ADVANTAGES OF THE INVENTION

The drying apparatus according to the invention has a funnel-shaped container into which the bulk material to be dried is placed and can be taken out. Furthermore, the passage of a drying gas through the container is possible such that the drying air flows through the bulk material. The container is characterized by a hopper wall whose angle of inclination can be adjusted at least partially, so that the capacity of the container is variable. This makes it possible to adjust the container to the desired amount of bulk material to be dried. This can be done either manually or, by means of a suitable actuator, automatically.

The adjustability of the angle of inclination of the hopper wall can have a positive influence on the discharge of the container contents. If the container is filled with a lesser amount there will be a steeper slope inside of the container. In the case of small amounts of bulk material, the steeper pitch of the hopper makes up for the lack of the weight of the granules in the upper area of the container pressing down on the granules being taken from the container. By means of the angular adjustment of the hopper walls the capacity of the container is simultaneously reduced. The smaller amount of bulk material therefore will have the same or a slightly lower level in the container than it will when the apparatus is used at full capacity. This brings it about that the drying air flows uniformly through the granules even when the volumetric flow is throttled, and it takes a path of defined length through the granules.

To change the angle of inclination and capacity of the container not all of the parts of the hopper wall need to be adjustable. Adjustable and fixed, substantially rigid wall parts can be used, which by their cooperation form the hopper. Just the same, however, it is conceivable to make the hopper out of an elastic material, whereby the capacity and slope of the hopper are achieved by an elastic deformation of the hopper.

An advantageous embodiment of the hopper provides for constructing it of a plurality of flat surfaces. At least one of them is to form an adjustable side of the hopper, so as thus to assure the adjustability of the hopper. An appropriate configuration of this variant is accomplished by providing a pyramidal hopper with four surfaces. Two opposite hopper surfaces are fixed, the other two being the adjustable sides. This keeps the expenditure on components for the bulk material container within limits and at the same time offers the possibility of adapting the hopper capacity and the angle of inclination of a sufficient portion of the hopper walls to the amount of bulk material. The stationary wall portions can be made steeper than the adjustable sides when in the position of maximum container capacity. Thus, even in the case of a low fill level in the container an optimal outfeed performance can be achieved. The stationary wall parts of the hopper can also be made at least partially also perpendicular.

In a practical embodiment of the idea of the invention the adjustable sides are hinged in the area of the outfeed opening. In this embodiment, by pivoting the adjustable sides, while keeping the size of the outfeed opening the same, the angle of the container walls as well as the capacity of the container can be varied. The means for fixing the adjustable sides in various angles of inclination can be provided, for example, on the stationary wall parts.

If the stationary wall parts are inclined, the result will be adjustable sides of a substantially trapezoidal shape. If the angle of inclination is varied, the result will be a different pitch at the lateral margins of the adjustable sides in the horizontal projection parallel to the stationary wall parts. This can be compensated by making the stationary wall parts of the container with an angle of inclination varying over the range of adjustment of the adjustable sides. This brings it about that a constant-size gap can be maintained between the outside margins of the adjustable sides and the stationary side parts throughout the range of adjustment of the adjustable sides. Additional sealers, such as rubber lips, for example, at the edges of the adjustable sides thus become superfluous.

In one of the stationary side walls a maintenance access opening can be disposed. This is easiest to achieve if this wall part is made perpendicular. The maintenance opening permits cleaning the container, for example, whenever other types of granular materials are to be dried with it.

The container can advantageously be double-walled, so that the drying air is carried through the hollow space thus formed, before reaching the bulk material. Thus the temperature loss in the container can be reduced, thereby reducing the thermal energy requirement. This measure is practical on account of the small amount of bulk material having an unfavorable ratio of volume to surface area.

The apparatus for drying bulk materials is an alternative solution for the purpose of permitting flexible use. This apparatus is supplemented by a dehumidifier, which can be integrated, especially also structurally, into the system unit of the drying container. This becomes possible by providing a membrane dryer for dehumidifying the drying air since, in comparison with the conventional dehumidifying apparatus referred to above, it is characterized by requiring little space. A cleansing gas inlet and a cleansing gas outlet are provided, which permit cleansing gas to pass through a cleansing section. The cleansing section is formed by the side of the membrane facing away from the drying section. Therefore the moisture passing through the membranes is picked up by the cleansing gas. This produces a difference in the partial pressure of the moisture between the two sides of the membrane, where by the operation of the membrane dryer is achieved.

A special embodiment of the invention provides a membrane dryer which permits passing the drying gas through a drying section formed by moisture-permeable membranes. The cross section of this drying section is selected such that a throttling effect is simultaneously achieved by the membrane dryer. The drying gas passing through therefore expands from a higher pressure level ahead of the membrane dryer to a lower pressure level after drying is done. This expansion of the drying gas separates the moisture on the membrane walls and diffuses through the membrane walls. The drying section can be formed, for example, from hollow fiber membrane tubes, such as those disclosed in DE 196 33 177 A1. After dehumidification, the drying gas is fed to the container to dry the bulk material.

The cleansing gas can advantageously be taken from the drying air duct behind the membrane dryer. For this purpose a cleansing gas duct branches off from the drying gas duct, which leads to the cleansing gas connection of the membrane dryer. For a successful dehumidification of the drying gas it is required that the cleansing gas flow be less than the drying gas flow, so that some drying gas stream can be made available to the drying container. For this purpose a throttling means is provided in the cleansing gas duct, which can be adjusted according to the amount of cleansing gas that is needed.

It is furthermore advantageous to provide a heater for the drying gas in the drying gas duct. In this manner the drying gas can be warmed to the ideal temperature for drying the granular material.

In a special embodiment of the idea of the invention, a filter is connected to the drying gas outlet from the container. This filter holds out particles which the drying gas has picked up as it flows through the granular material. The filter thus prevents the work space from being fouled by any dusts that might be produced from the granules. The dust can be recovered for the process, for example by providing a centrifugal separator.

A special embodiment of the invention provides for taking the drying gas from a compressed-air system and feeding it through a compressed-air line to the membrane dryer. By means of a drying gas throttling device, which is preferably installed in the compressed-air line, the required amount of drying air can be set. The drying gas throttling device can be configured preferably as a cycling valve which by time-controlled activation reduces the compressed air rate of flow, the full pressure of the supply of compressed air being available when the drying gas throttle is in the open state. This assures that the optimum pressure drop for the drying of the drying gas is achieved at the membrane dryer. The compressed air must be cleaned in the membrane dryer before delivery. The filter means provided for this purpose can be of two-stage construction. In the first stage the removal of coarse particles is achieved by a paper filter, for example, and the fine stage serves mainly for removing oil from the compressed air.

The arrangement with a filter at the drying air discharge from the container and the removal of the drying air from the compressed air system results in an open circuit of the drying gas. As an alternative, the compressed air can also be produced within a closed drying air circuit in the apparatus itself. For this purpose, after leaving the container the drying air is fed back to the pressure generator in order then to pass again through the membrane dryer. An open circuit has the advantage that, to achieve the desired drying gas temperatures, only the heater is necessary for the dry gas issuing from the container, without the additional use of return air coolers. The reduced expenditure on components saves costs and results in a compact form of the apparatus.

In an additional embodiment of the invention, the apparatus described is operated with a control system. The control system can evaluate, for example, the signals of a temperature sensor which is situated between the heater and the container, of a temperature sensor at the drying gas outlet from the container, and of a moisture sensor behind the outlet from the membrane dryer. The cleansing air throttle device can be controlled according to the residual moisture content of the drying gas, and in this manner constant residual moisture content can be made available to the drying container. The temperature sensor following the heater can be used in order to control the temperature of the drying gas. The temperature sensors continue to be used for comparing the temperature of the drying gas before and after passing through the container. In this manner a thermal balance can be established by means of which information can be obtained on the progress of the drying process. The control unit can still be connected to the outfeed opening of the container, and the outfeed of dried granules can be made to depend on their moisture content. It is conceivable to operate the apparatus either by the batch method or by the continuous method.

Due to the small size and simple construction of the different components the apparatus can be integrated in a housing or supporting frame. The result is a system of compact design and light weight which is flexible in operation. In this manner the apparatus of the invention can be quickly employed at places where the feeding of small flows of granular material is desired. For the compressed-air variant of the apparatus all that is necessary is a compressed-air connection and an electrical connection for control and for heating. Connections of this kind are available at most installation sites, so that no modifications are needed for the use of the apparatus. By matching the container volume the flow of drying air can be reduced to a minimum by the drying air throttling means. The apparatus therefore consumes only as much compressed air as is required for the fill depth. This contributes to economical operation of the apparatus according to the invention.

These and additional features of preferred embodiments of the invention will be found not only in the claims but also in the description and the drawings, and the individual features can be realized each by itself or together in the form of subcombinations in the embodiment of the invention and in other fields, and can constitute advantageous as well as independently patentable embodiments, for which protection is hereby claimed.

DRAWING

Additional details of the invention are described in the drawings with the aid of schematic embodiments.

FIG. 1 shows a block circuit diagram of an apparatus that is fed by a compressed-air supply system, a membrane dryer to dehumidify the drying air, and the container having adjustable hopper walls.

Figure 2:
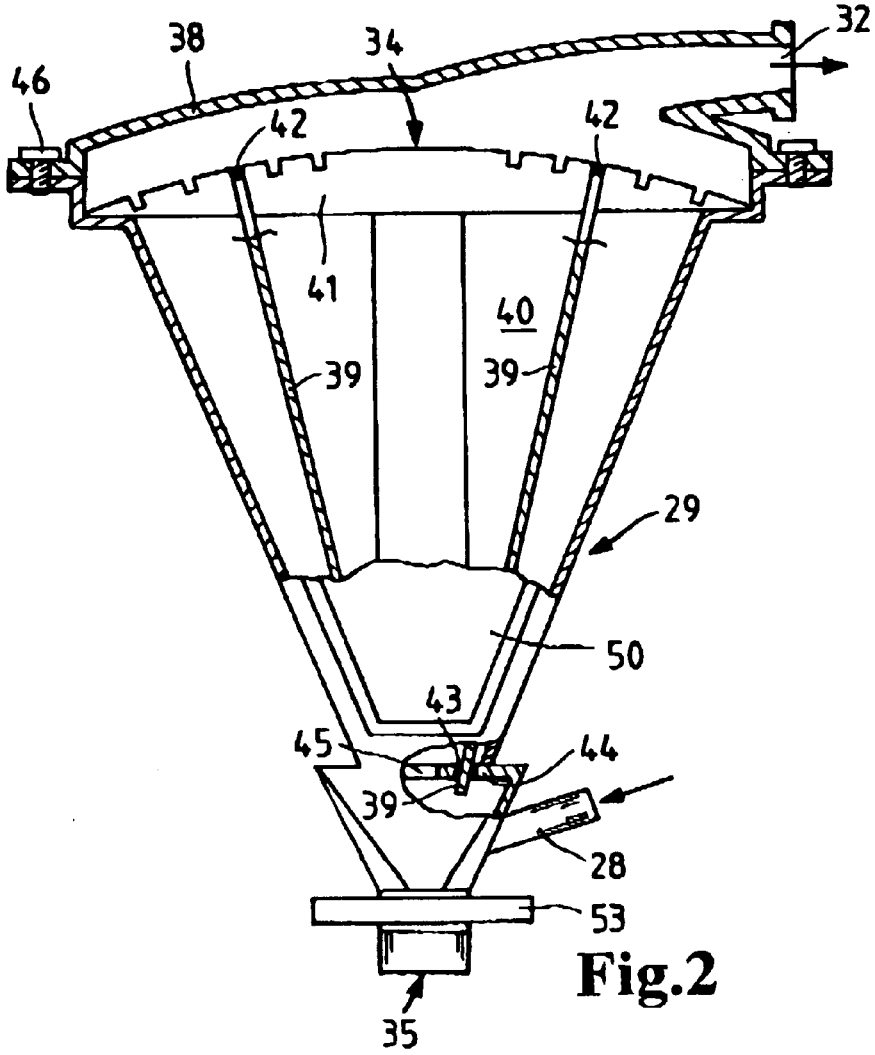

FIG. 2 a hopper-shaped container shown in a side view, partially in section, for drying bulk materials, and FIG. 3 the container of FIG. 2 in a view from below.

DESCRIPTION OF THE EMBODIMENTS

The course which the drying air follows through the apparatus for drying bulk materials can be seen in FIG. 1. The drying air is taken from a compressed-air source 10 and fed through a compressed-air line 11 to a membrane dryer 12. In the compressed air line 11, a prefilter 13 for separating particles is disposed, and a deoiler 14 for separating the air in the compressed air. The deoiler 14 has a return line 15 which returns the separated oil to the compressed-air system. Furthermore, a cycling valve is provided as a drying gas throttling means 16 in the compressed-air line 11. The drying gas floods through the membrane dryer 12, passing through a drying section 17 that is formed of tubular membranes 18. In passing through the drying section the drying gas yields most of its moisture and is led into a drying gas line 19 where it passes through a moisture sensor 20 to determine the residual moisture. In the drying gas line furthermore a cleansing gas line 21 branches off, and leads to a cleansing gas connection on the membrane dryer 12. The cleansing gas throttling means 23 is a magnetic valve in the cleansing gas line 21 which limits the cleansing gas flow through a cleansing section 24 of the membrane dryer 12. The cleansing gas absorbs the moisture passing through the membrane and leaves the membrane dryer 12 through a cleansing gas outlet 25. The drying gas passes through a drying gas heater 26 and a temperature sensor 27 in the drying gas line 19, and then is fed through the inlet 28 to a container 29. The container 29 has adjustable hopper walls 30 and is filled with bulk material 31. The drying gas flows through the bulk material 31 from the bottom up and is carried out of the container through an outlet 32. Here there is an additional temperature sensor 27 and a filter 33. The bulk material 31 can be loaded through an infeed 34 into the container 29 and is removed again through an outfeed opening 35. The infeed opening 34 and outfeed opening 35 are made closable.

The container 29 has a double wall 54 through which the drying air can be fed alternatively through a bypass line 55. It then reaches the inlet 28 through feeders 56.

A control system 36 is provided for the operation of the apparatus. This control system evaluates the signals from the moisture sensor 29 and the temperature sensors 27 via control lines 37. The operation of the drying air throttling means 16, the cleansing air throttling means 23, the drying air heater 26 and the outfeed opening 35 are dependent upon this evaluation. In addition, other sensors can be provided, such as a fill level sensor for the bulk material (not shown), for example. The control system also allows manual control of the apparatus.

FIG. 2 shows an embodiment of the hopper-shaped container 29. This represents a closed system which has the infeed 34 and the outlet opening 35 for the bulk material and the inlet 28 as well as the outlet 32 for the drying gas. The container has a cover 38 with which the infeed 34 can be opened and adjustment of the adjustable sides 39 can be performed. The adjustable sides 39 form together with stationary wall parts 40 the surfaces of the hopper-shaped container. At the upper end of the stationary wall parts 40 a notched bar 41 is provided which cooperates with lugs 42 on the adjustable sides 39. At the bottom end the adjustable sides 39 are inserted into slots 43 in an intermediate bottom 44 of the container. These slots operate as a hinge, so that the angle of inclination of the adjustable sides 39 can be changed by slightly raising the adjustable side 39 and disengaging the lugs 42. The adjustable sides are locked by engaging the notched bar 41. The intermediate bottom 44 has an opening 45 in the middle for the bulk material to pass through. To fill the container with bulk material, locking means 46, screw fasteners 46 for example, are removed and the cover taken off. This opens the infeed 34 of the container. At the same time, with the cover 38 open, the hopper inclination can be adjusted.

Figure 3:
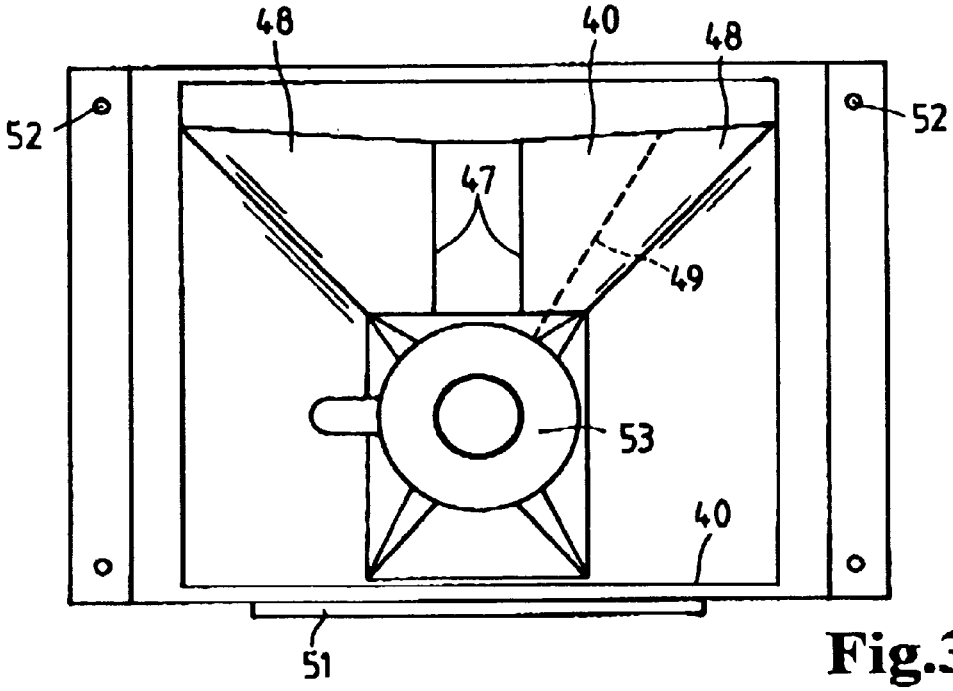

The configuration of the stationary wall parts 40 is shown in FIG. 3. One of them is set at an angle and has two seams 47, i.e., consists of three planar wall parts. The inclination of the triangular surfaces 48 thus produced assures that lateral margins 49 (indicated by a broken line in FIG. 3) will always be in contact with the inner side of the triangular surfaces 48. The other stationary wall part 40 is perpendicular and has an access opening 50 (see FIG. 1) which is closed by a maintenance cover 51. Also on the container are mounting holes 52 which permit the container to be integrated with a housing or mounted on a frame. By means of a flange 53 the container can be fastened, for example, on a plastic injection molding machine, in which case the outlet opening communicates with an inlet of the injection molding machine, which is not shown.

What is claimed is:

1. Apparatus for drying bulk materials, which has an at least partially hopper-shaped container with an infeed and a closable outfeed opening for the solids, an inlet and an outlet for a drying gas being disposed on the container such that the drying gas stream passes through the solids, wherein the volume of the container is variable by a hopper wall adjustable at least partially in its angle of inclination.

2. Apparatus according to claim 1, wherein the container consists of a hopper-shaped area of at least three planar surfaces, of which at least one is configured as an adjustment side which is adjustable in its angle of inclination.

3. Apparatus according to claim 2, wherein the container consists of a hopper-shaped area of at least four planar surfaces, of which two opposite adjustment sides are adjustable in their angles of inclination.

4. Apparatus according to either one of claim 2 or 3, wherein at least one adjustment side is mounted pivotingly in the area of the outfeed opening and can be fixed in different inclined positions in the area of the infeed.

5. Apparatus according to any one of claims 1, 2 or 3, wherein the container comprises stationary wall parts configured such that the adjustable wall parts, independently of their position within the provided adjustment range, are in contact at their lateral margins with inside surfaces of the stationary wall parts.

6. Apparatus according to claim 1, wherein a maintenance opening is disposed in a stationary wall of the container.

7. Apparatus according to claim 1, wherein the hopper-shaped container is constructed at least partially with double walls, the double wall forming a space for the passage of the drying gas.

8. Apparatus for drying solid substances in granule or powder form, which has an at least partially hopper-shaped container with an infeed and a closable outfeed opening for the solid substances, an inlet which is preceded by a dehumidifier for the drying gas, and an outlet arranged such that the drying gas stream passes through the solids, wherein the dehumidifier is a membrane dryer with a drying section for the drying gas and a cleansing section for a cleansing gas, the cleansing section being formed by the side of the membranes facing away from the drying section.

9. Apparatus according to claim 8, wherein the drying section formed by moisture-permeable membranes is configured as a throttling means for the drying gas.

10. Apparatus according to claim 8, wherein a cleansing gas line provided with a cleansing gas throttling means is provided, which branches off from a drying gas line connecting the membrane dryer and the container, and is connected to a cleansing gas connection.

11. Apparatus according to claim 8, wherein the drying gas is conveyed through a drying gas line having a drying gas heater.

12. Apparatus according to claim 8, wherein the outlet is followed by a filter.

13. Apparatus according to claim 8, wherein the membrane dryer is connected to a compressed air line which has a drying gas throttling means and filter means for cleaning the compressed air, and the apparatus has a container with a hopper wall which is adjustable at least partially in its angle of inclination.

14. Apparatus according to any one of claims 8 to 11, wherein a moisture sensor is provided in a line which conveys the drying gas, and one temperature sensor is provided in the dry gas stream ahead of the inlet and another moisture sensor following the outlet, which are connected to means for controlling a drying gas throttling means, a cleansing gas throttling means, a drying gas heater or the outfeed opening.

* * * * *